US005607076A

United States Patent [19]

Anthony

[11] Patent Number: 5,607,076

[45] Date of Patent: Mar. 4, 1997

[54] SPILL AND SCALD RESISTANT BEVERAGE APPARATUS

[76] Inventor: Michael M. Anthony, 11899 NW. 31st Court, Coral Springs, Fla. 33065

[21] Appl. No.: 356,444

[22] Filed: Dec. 13, 1994

[51] Int. Cl.[6] ..... B65D 77/04

[52] U.S. Cl. ..... 220/501; 220/506; 220/703

[58] Field of Search ..... 220/501, 506, 220/703, 711, 714

[56] References Cited

U.S. PATENT DOCUMENTS

| | | | |
|---|---|---|---|
| 2,217,833 | 10/1980 | Chapman | 220/703 |
| 4,928,848 | 5/1990 | Ballway | 220/703 |
| 5,275,277 | 1/1994 | Gallegos | 220/703 |
| 5,284,028 | 2/1994 | Stuhmer | 220/703 |

*Primary Examiner*—Joseph Man-Fu Moy
*Attorney, Agent, or Firm*—McHale & Slavin, P.A.

[57] ABSTRACT

The instant invention is a beverage container having a primary purpose of lowering the temperature of a beverage directly before consumption. The device is used in combination with a conventional beverage cup defined by an outer sleeve which operates in association with the beverage cup to form a passageway for the convection of heat to lower the temperature of beverage passing through the passageway. In operation the beverage cup is placed in an inverted sealed position thereby maintaining the beverage in a hot or cold serving temperature for a longer period of time. The passageway further prevents spills and lessens the possibility of skin burning by limiting the amount of beverage that can be spilled as well as providing a radiant cooling affect for lowering of beverage temperature. A lid is further provided for concealing the beverage cup and sleeve formed passageway providing a free air space for uninhibited beverage consumption.

14 Claims, 3 Drawing Sheets

SPILL AND SCALD RESISTANT BEVERAGE APPARATUS

FIELD OF THE INVENTION

The instant invention relates to beverage containers and in particular to a device for use in combination with a conventional beverage cup for lowering the temperature of a portion of a beverage immediately before consumption and reducing the probability of spilling the beverage.

BACKGROUND OF THE INVENTION

It is well known that various types of beverages must be served hot to satisfy the consumer. Coffee is most noteworthy in that it requires an extremely high cooking temperature in order to draw the richest flavors from the coffee beans. Consumers not only enjoy this rich flavor but demand it despite how hot the coffee must be served. Consumers who do not like the high temperature allow the coffee to cool in order to meet their individual preference.

A problem arises in that the hot beverage may be served scalding hot. This temperature may burn an individual's mouth or body should it be spilled. The problem is even more prevalent in light of the consumer's preference to drink the hot beverage while moving in an automobile, boat, airplane, and so forth. Drive through restaurants promote such consumption and possible burns by using disposable styrofoam cups with plastic lids that can be easily spilled. Failure of a cup resulted in the spilling of hot coffee on a consumer which resulted in one of the largest personal injury awards ever granted for the individual was badly burned while attempting to consume coffee in an automobile.

Thus what is needed in the art is a beverage holder that is capable of maintaining beverages at an extremely hot temperature so as to maintain the desired flavor yet provide a means for cooling a sufficient quantity of the beverage immediately before consumption and reduce the probability of spillage.

SUMMARY OF THE INVENTION

The instant invention is a beverage cup container for use in combination with a conventional beverage cup. The device consists of a conventional cup having flat bottom and curvature side wall defining an interior chamber used to hold hot or cold beverages. The conventional cup can be made of disposable styrofoam, paper, or be made of a reusable material such as plastic or ceramic.

A cup shaped sleeve defined by a flat top and a curvature side wall having a spiral formed indentation defining an interior chamber is sized to fictionally engage the outer surface of the conventional cup.

In operation the cup shaped sleeve is positioned over a filled beverage operating like a cover. As the inner surface of the cup shaped sleeve engages the outer surface of the beverage cup, the indentation operates to form an aperture therebetween providing a rotational passageway allowing the expelling of air.

When the beverage cup is fully encompassed the combination is inverted exposing the bottom of the beverage cup which is then depressed slightly providing additional insertion to a fixed position so as to provide a free air space beneath the lip of the sleeve.

Fluid equalization allows the beverage disposed within the cup to partially fill the passageway. The passageway directs the beverage to flow up the outer formed passageway which operates to convect excess heat through the nominal sidewalls of the sleeve to lessen the temperature of the beverage. When the consumer grasps the container, there is a further transfer of heat to the individual's hand.

The beverage can be consumed in the conventional manner wherein the rim of the sleeve operates as the rim of a conventional cup. When the beverage container is tilted, beverage contained in the passageway drains to the top surface of the inner cup allowing free flowing consumption. The beverage is cooled during its travel through the passageway thus preventing scalding of the mouth. Should the beverage container be dropped, the spilled beverage will be limited to the amount of fluid in the passageway which will have been cooled during the flow through the passageway thus eliminating the scalding ability.

A lid can be placed on the end of the sleeve opening having a lift tab to allow the consumer to draw beverage by simply tilting of the container as previously described. Should the device be dropped, only the amount of beverage contained within the passageway can spill. This is further limited by the positioning of a spilled beverage in relation to the lid decreasing the chance of spillage to those instances where the lid has fallen off or the drinking aperture has rotated to a bottom position.

The passageway has sufficient outer surface area allowing for the convection of heat in a radiator type relationship for cooling to an acceptable level. The outer sleeve further operates as an insulator to the inner cup, now in an inverted state, which prevents the escape of steam thus maintaining the beverage in an original serving status for a longer period of time.

In an alternative embodiment, the outer sleeve may further include a flat surface with an internal positioned passageway allowing the beverage device to assimilate a conventional cup. A secondary chamber may then operate as an insulator or be used for adding cream or milk at a controlled rate.

Thus an objective of the instant invention is to disclose a beverage container capable of reducing heat from a beverage immediately before consumption to alleviate the danger of scalding during consumption and when the beverage is accidentally spilled.

Yet another objective of the instant invention is to disclose a beverage container capable of maintaining the heat of a beverage for an extended period of time by providing a sealed environment with a small amount of the beverage cooled before consumption.

Yet still another objective of the instant invention is to provide a means for admixing milk, cream or the like substances to a primary stored beverage at a controlled rate.

Still another objective of the instant invention is to provide a beverage device that may further operate as a cold thermos with the ancillary benefit of preventing the accidental swallowing of ice cubes.

Other objectives and advantages of this invention will become apparent from the following description taken in conjunction with the accompanying drawings wherein are set forth, by way of illustration and example, certain embodiments of this invention. The drawings constitute a part of the specification and include exemplary embodiments of the present invention and illustrate various objects and features thereof.

DETAILED DESCRIPTION OF THE PREFERRED EMBODIMENT

Although the invention is to be described in terms of a particular embodiment it will be readily apparent to those skilled in this art that various modifications, rearrangements and substitutions can be made without departing from the spirit of the invention. The scope of the invention is defined by the claims appended hereto.

Figure 1:
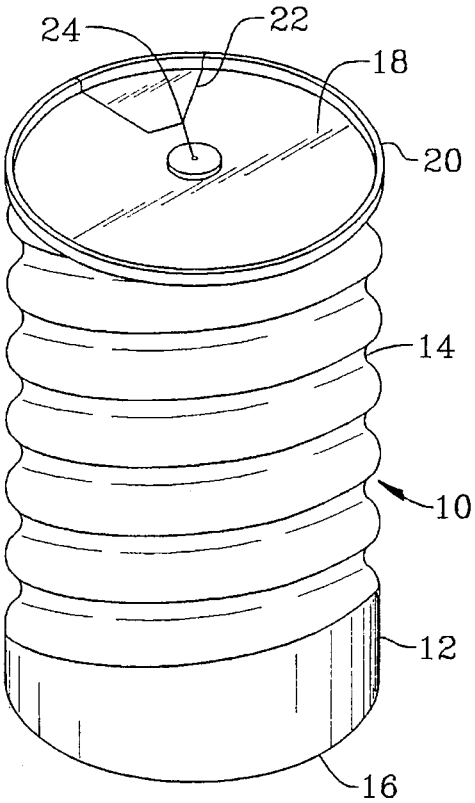
FIG. 1 is a pictorial view of the instant invention.

FIG. 1 is a pictorial view of the instant invention 10 consisting of an outer sleeve 12 which conceals a conventional beverage cup, having a sidewall surface area 14 including a spiral shaped indentation extending from a bottom surface 16 to a removable lid 18. The lid 18 includes a perimeter edge 20 available for coupling to an upper rim of said outer sleeve 12 and includes a provision for accessing fluid beneath the lid 18 through use of drinking aperture disposed beneath lift tab 22. Vent 24 allows air displacement as necessary. The outer sleeve 12 and lid 18 can be constructed from a nominal sidewall of reusable plastic, or disposable styrofoam and/or paper. Spiral shaped indentation 14 may be V-shaped or have a square configuration with a primary purpose of providing sufficient surface area for the dissipation of heat through said sidewall.

Figure 2:
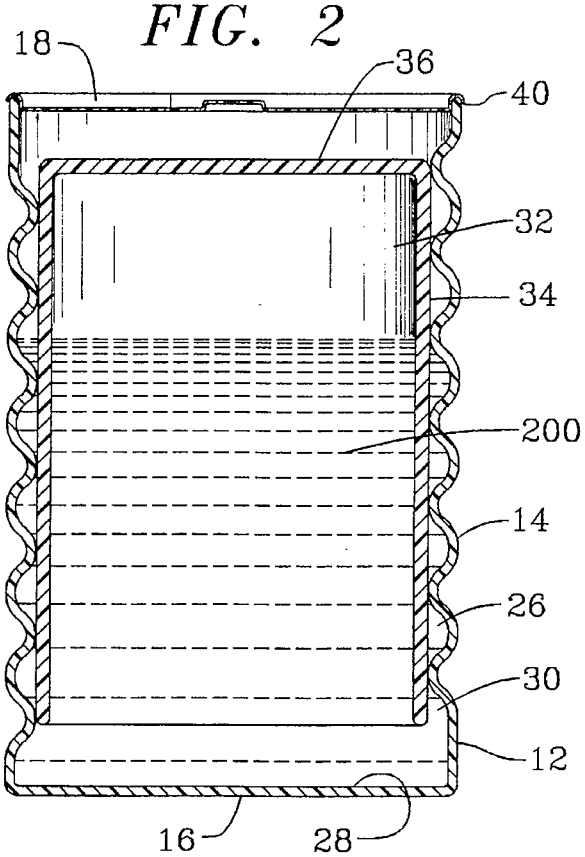
FIG. 2 is cross-sectional side view of FIG. 1 illustrating a beverage placed within the container.

Now referring to FIG. 2, shown is a cross-sectional side view of the invention wherein the outer sleeve 12 with the spiral sidewall 14 is shown winding a fluid passageway 26 from an inner surface 28 along the lower end 16 of the outer sleeve 12 allowing beverage fluid 200 to equalize in depth by allowing fluid to flow into passageway 26 along opening 30. Conventional cup 32 is shown in an inverted position having continuous side wall 34 and end wall 36. Cup 32 may be formed from paper, styrofoam, plastic, ceramic, or the like material capable of holding extremely hot or cold beverages. When cup 32 is placed in an inverted position, the beverage 200 is allowed to flow against the inner side wall 28 of the end 16 for entrance into aperture passageway 26 along opening 30. Lid 18 is depicted locked onto the free end 40 of the sleeve 12 assimilating a conventional beverage cup with a spill resistant lid.

Figure 3:
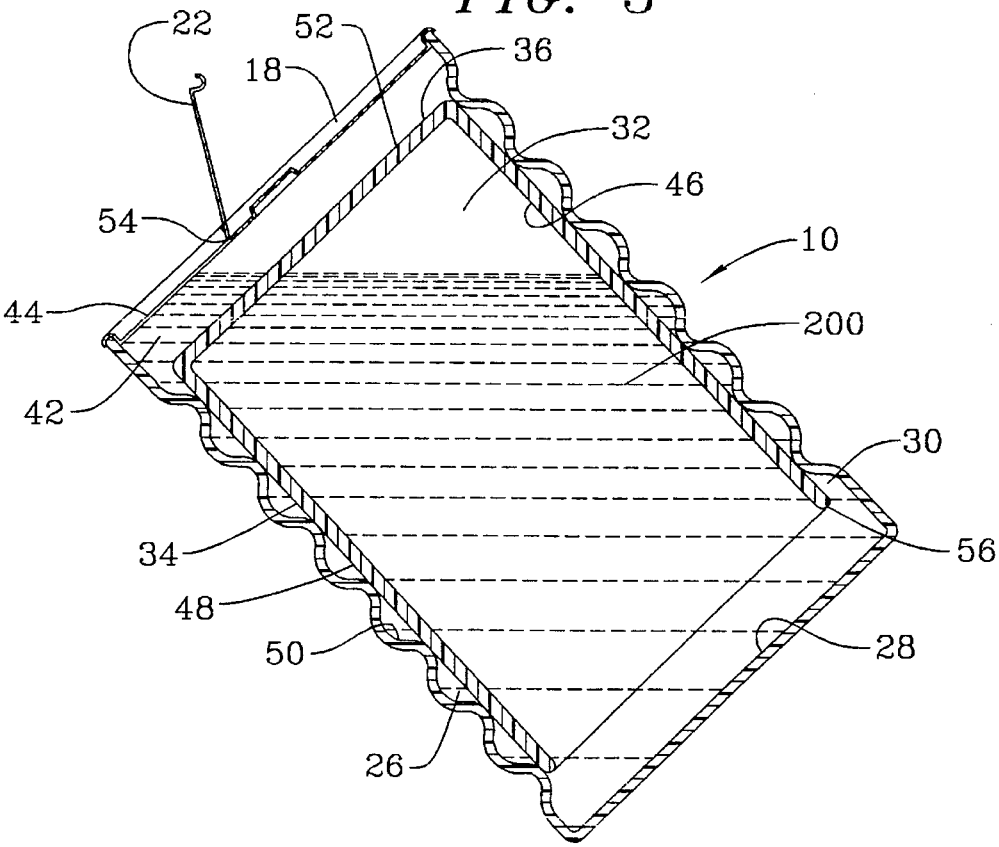
FIG. 3 is a cross-sectional side view of FIG. 1 illustrating a beverage container or tilted so as to depict fluid flow through a passageway.

As shown in FIG. 3 in operation when the device 10 is tilted, the beverage 200 is inhibited from flowing out of end 36 of the inner cup 32 and is forced to travel through passageway 26 into opening 42 where it may be consumed through the opening 44 located beneath the lid 22. In this embodiment the cup 32 utilizes the inner surface area side wall 46 to originally hold the beverage and when placed in a inverted position operates to confine the beverage 200 within the side wall 46. The bottom wall 36 now operates as a top wall to maintain heat from escaping thus maintaining the beverage in a hot or cold state for a lower period of time than what is possible with an open beverage.

It is further noted that cola's retain their carbonation for the gas cannot escape through the inverted wall. For this reason the device 10 may also be used as a cold thermos wherein the beverage 200 can be maintained in a cool condition by the same principles as previously described. In addition, ice cubes are maintained along the top surface thereby not impeding flow into the passageway 26. This is especially beneficial to young children as an ice cube cannot flow through the passageway 26 thus preventing lodgement into a child's throat. The passageway 26 is thus formed by an outer surface 48 of the side wall 34 against an inner surface 50 of said sleeve. The free space 42 allows sufficient area between the bottom surface 52 of end 36 and the inner surface 54 of lid 18. In operation, the consumer is only able to consume as much fluid as found in the free space 42 and fluidly communicated passageway 26. This does not inhibit normal drinking practices but will inhibit an attempt to chug the entire beverage at one setting. The container 10 must be placed back into an upright position allowing the beverage 200 to refill the passageway 26 by displacing with air for subsequent tilting and consumption.

This limited amount of fluid prevents a large spill of the beverage should the device be tipped even if the lid 18 is not in use. For instance, if the device is dropped, the only amount of beverage that can spill is that located in the free space 42 and adjoining fluidly communicated passageway 26. Similarly, if the lid 18 is maintained in place and only the lift tab 22 is open, should the beverage be dropped then the amount of spillage is dependent upon the positioning of the opening 44. If the opening 44 is in an upright position then no fluid would escape, should the opening 44 be at a ninety degree angle relative to a horizontal plane then again no spillage would be predicted as the opening 26 and free space 42 should be sufficient to hold the beverage in position. If the opening 44 is closest to the surface in a horizontal plane then the amount of fluid leakage is limited to that found in the free space 42 and passageway 26 as the beverage within the inner cup 32 cannot flow through the passageway as some of the spiral passageway is at a position higher than the fluid level.

In this embodiment inner surface 48 and outer surface 50 fictionally engage each other to prevent the cup 32 from movement along the surface of said sleeve. The upper edge 56 of the now inverted cup 32 may be positioned by the use of a positioning mound, not shown, which would prevent the upper edge 56 from contacting the inner surface 28 of the bottom 16. As previously noted, the opening to the passageway 26 is depicted by numeral 30 and extends to the inner surface 28 of the bottom wall 16 making it difficult to completely seal under normal conditions. In operation the cup 32 need only be inserted partially into the outer sleeve 12 providing sufficient free air space 42 as shown by way of illustration.

Figure 4:
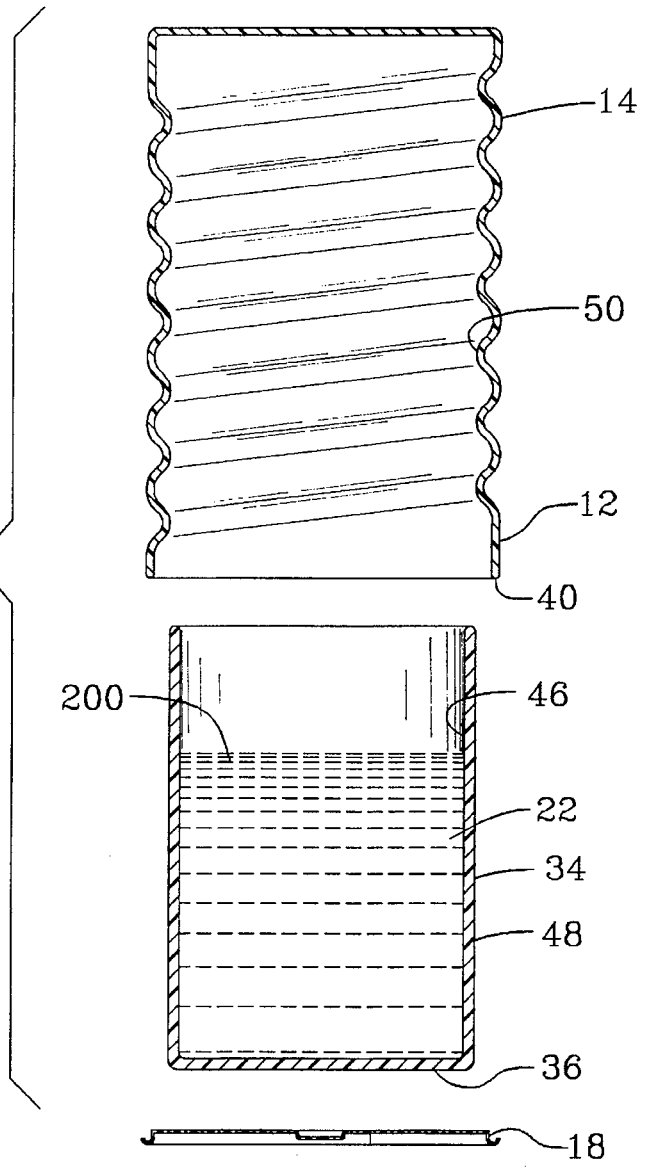
FIG. 4 is a exploded view of the instant invention.
Figure 5:
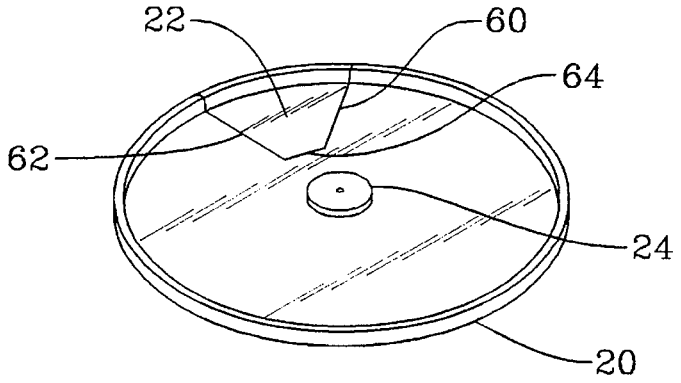
FIG. 5 is a top view of the cover of the instant invention.

Now referring in general to FIGS. 4 and 5 shown is an exploded view of the instant invention having a conventional cup 32 defined by an interior surface wall 46 formed by side wall 34 and bottom wall 36. The outer surface 48 of the side wall 34 is sized to accommodate frictional engagement with the inner side wall 50 of sleeve 12. As noted by way of illustration, the sleeve 12 has a plurality of ridges 14 placed at dissimilar positions across the circumference of the sleeve 12 which are operatively associated with the side wall surface 48 so as to perform the aforementioned passageways fluidly communicating one portion of the sleeve to be enclosed with an open portion of the sleeve which would be opened for attachment and sealing by lid 18. Lid 18 assimilates a conventional beverage cover constructed from plastic having a ventilation hole 24 and a perimeter ridge 20 available for coupling to free edge 40 of the sleeve 12. A drinking aperture is formed with cut lines 60 and 62 allowing the drinking aperture to be exposed by lifting of tab 22 where it can be biased in a position allowing free access to the aperture along hinge line 64 or alternatively the hinge 64 can be torn from its position allowing free access to the aperture.

As shown by way of illustration in FIG. 4 the cup 34 can be used in its conventional manner with a beverage 200 placed therein. Should the consumer choose to take the beverage to a location where open top cooling is not acceptable, the sleeve 12 can be placed in a position as depicted and slid over the top of the cup 34 with excess air expelled through the passageways as formed by placement of inner side wall 50 against outer side wall 48. Once the sleeve 12 has been inserted over the length of the cup 34, the cup 34 and sleeve 12 are inverted and the end 36 of the cup 34 pushed inward approximately a quarter of an inch or as provided by a stop mechanism within the sleeve at which time the beverage is allowed to flow into the now formed passageways surrounding the cup 34. The passageways operate to increase surface area to allow convection cooling of the beverage using ambient temperatures as well as the consumer's hand further propagating the cooling of only the beverage contained within the passageways. The lid 18 is then available for placement over the open end and locked onto rim 40.

Figure 6:
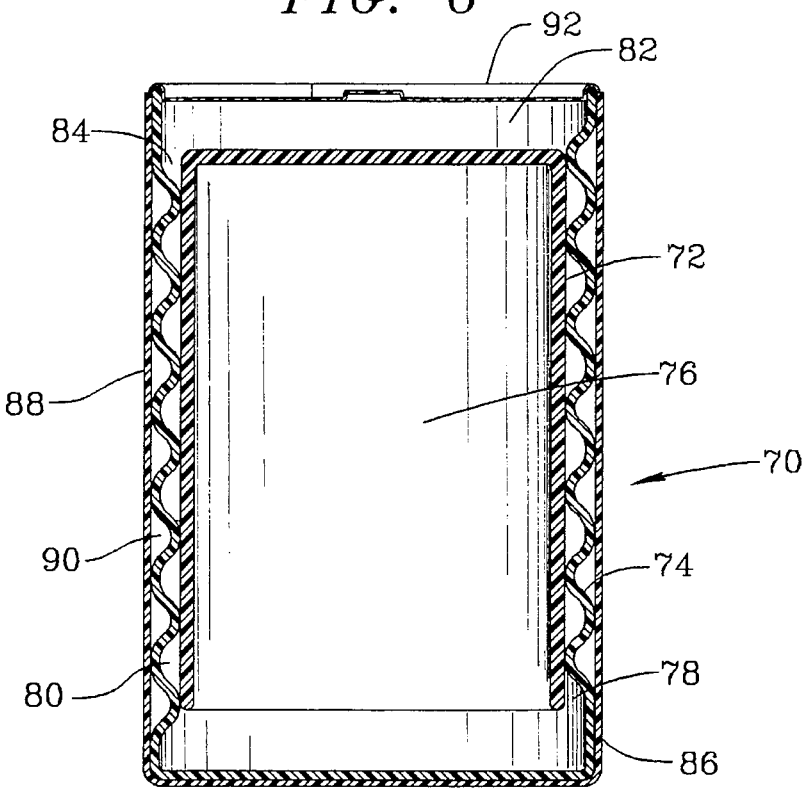
FIG. 6 is an alternative embodiment of the instant invention having a flat outer surface.

Now referring to FIG. 6 shown is an alternative embodiment 70 of the instant invention. The cross sectional view of the assembled invention shows an inverted cup 72 in the same format as previously mentioned having an outer sleeve 74 forming an interior chamber 76 with an aperture opening 78 leading into aperture passageway 80. As previously described beverage may flow through the passageway 80 and is directed into free air space 82 through the aperture opening 84. In this embodiment an outer sleeve 86 is positioned providing a smooth outer surface 88 wherein convection of heat is transpired through the apertures 80 through free air space apertures 90 for convection through sidewall 88. The free air space further operates to dissipate heat and reduce condensation. The flat sidewall provides a more conventional type beverage holder and can be formed integral to the aperture formation of inner sleeve 74. Lid 92 is available for attachment to the inner sleeve 74 and/or the outer sleeve 86.

Figure 7:
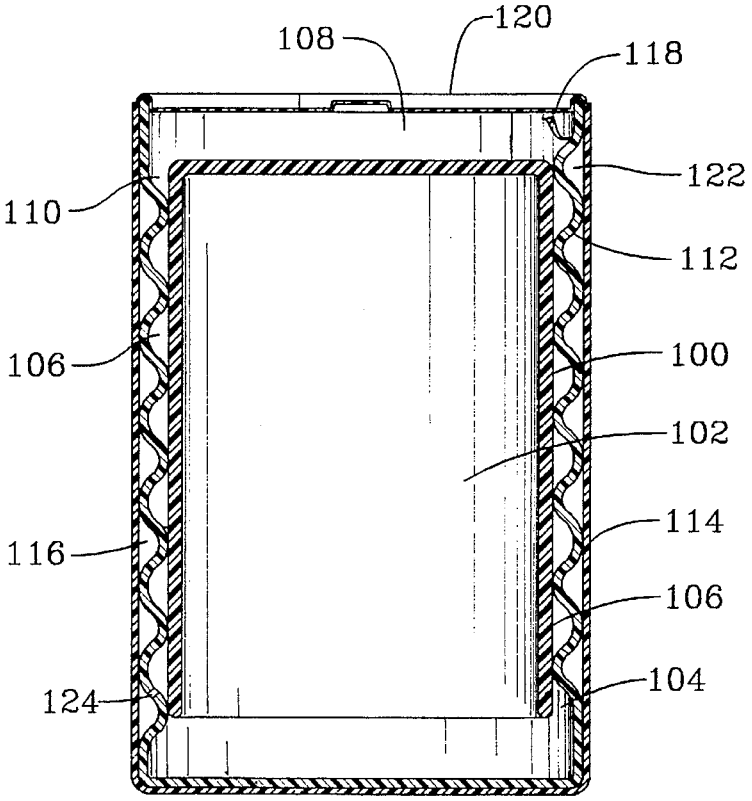
FIG. 7 is a cross-sectional side view of a FIG. 6 including access to a secondary aperture for placement of alternative fluids for mixing with the beverage.

Now referring to FIG. 7 shown is still another embodiment of the instant invention having a similar array of components as previously described in FIG. 6 with an inner cup 100 set forth in an inverted position having an interior chamber 102 fluidly communicated with aperture inlet 104 to passageway 106 which communicates to free air space 108 at aperture outlet 110. In this embodiment the sleeve 112 which creates passageway 106 includes an outer sleeve 114 providing a secondary aperture passageway 116. Resealable opening such as tape 118 is placed beneath lid 120 allowing the consumer to insert cream, milk, or the like commonly admixed fluid into the passageway 106. By insertion of fluid through this aperture opening 122 the fluid will flow to a pin hole orifice 124 to allow admixing of the fluid with the beverage contained in the passageway 106. The orifice will only release fluid when the beverage is flowing past the orifice opening.

It is to understood that while I have illustrated and described certain forms of my invention, it is not to be limited to the specific forms or arrangement of parts herein described and shown. It will be readily apparent to those skilled in the art that various changes may be made without departing from the scope of the invention and the invention is not to be considered limited to what is shown in the drawings and described in the specification.

What is claimed is:

1. A spill and scald resistant beverage device comprising:

a conventional cup defined by a continuous first curved side wall having an inner surface and an outer surface bordered by an upper perimeter rim spaced apart from a lower perimeter edge, said lower perimeter edge sealingly connected to a bottom wall having a top surface and a bottom surface with said inner surface of said side wall and said top surface of said bottom wall defining a first interior chamber;

an annular housing means sized to encompass said conventional cup and defined by a cup shaped sleeve having a continuous second curved side wall of nominal thickness with an inner surface and an outer surface bordered by an upper perimeter edge spaced apart from a lower perimeter rim, said upper edge sealingly connected to a top wall, said inner surface of said second side wall and an inner surface of said top wall defining a second interior chamber;

means for fluidly communicating said first interior chamber to said second interior chamber;

whereby said beverage device is formed upon placement of a beverage in said first interior chamber of said conventional cup and positioning said annular housing means over said beverage filled cup positioning said bottom wall of said beverage filled cup within said perimeter rim of said annular housing forming a free air space between said bottom wall of said filled beverage cup and said lower perimeter rim, wherein beverage is consumed by inverting the beverage device allowing beverage to flow to said free air space by said means for fluidly communicating said first and second chambers when the device is tilted.

2. The beverage device recited in claim 1, wherein said means for fluidly communicating said first interior chamber to said second interior chamber is defined by a spiral shaped indentation formed in said side wall of said annular housing forming a spiral passageway when said annular housing is positioned over said conventional cup allowing an inner surface of said indentation to fricitionally engage said outer surface of said conventional cup.

3. The beverage device recited in claim 1, wherein said means for fluidly communicating said first interior chamber to said second interior chamber is defined by a spiral shaped indentation formed in said side wall of said conventional cup providing a spiral passageway when said annular housing is positioned over said conventional cup allowing an outer surface of said indentation of said conventional cup side wall to fricitionally engage said inner surface of said annular housing.

4. The beverage device recited in claim 1 including a lid formed from a single piece of plastic securable to said perimeter rim of said annular housing means to cover said free air space, said lid including a resealable opening allowing beverage to consumed from said free air space.

5. The beverage device recited in claim 4 including a means for venting said lid allowing for the displacement of beverage by replacement of air.

6. The beverage device recited in claim 2 wherein said indentations are formed to provide optimum convention cooling while maintaining an ascetically pleasing sidewall.

7. The beverage device recited in claim 1 including a side wall enclosure having a smooth vertical sidewall disposed over said annular housing means.

8. A spill and scald resistant beverage device comprising:

a conventional cup defined by a first continuous curved side wall having an inner surface and an outer surface bordered by an upper perimeter rim spaced apart from a lower perimeter edge, said lower perimeter edge sealingly connected to a bottom wall having an inner surface and an outer surface with said inner surface of said side wall and said bottom wall defining a first interior chamber;

an annular housing means sized to encompass said conventional cup and defined by a cup shaped sleeve having a second continuous curved side wall of nominal thickness having an inner surface and an outer surface bordered by an upper perimeter edge spaced apart from a lower perimeter rim, said upper edge sealingly connected to a top wall, said inner surface of said side wall and an inner surface of said top wall defining a second interior chamber, said side wall having a spiral shaped indentation providing a passageway fluidly communicating said first interior chamber to said second interior chamber when said annular housing is positioned over said conventional cup, raised ridges of said indentation of said inner surface of said annular housing side wall fricitionally engaging said outer surface of said conventional cup;

whereby the beverage device is formed upon placement of a beverage in said first interior chamber of said conventional cup and positioning said annular housing means over said beverage filled cup positioning said bottom wall of said beverage filled cup within said perimeter rim of said annular housing forming a free air space between said bottom wall of said beverage filled cup and said lower perimeter rim, wherein beverage is consumed by inverting the beverage device allowing beverage to flow through said passageway to said free air space when the device it tilted.

9. The beverage device recited in claim 8 including a lid formed from a single piece of plastic securable to said perimeter rim of said annular housing means to cover said free air space, said lid including a releasable opening allowing beverage to consumed from said free air space.

10. The beverage device recited in claim 8 including a side wall enclosure having a smooth vertical sidewall disposed over said annular housing means.

11. A spill and scald resistant beverage device comprising:

a conventional cup defined by a first continuous curved side wall having an inner surface and an outer surface bordered by an upper perimeter rim spaced apart from a lower perimeter edge, said lower perimeter edge sealingly connected to a bottom wall having an inner surface and an outer surface with said inner surface of said side wall and said bottom wall defining a first interior chamber;

an annular housing means sized to encompass said conventional cup and defined by a cup shaped sleeve having a second continuous curved side wall of nominal thickness having an inner surface and an outer surface bordered by an upper perimeter edge spaced apart from a lower perimeter rim, said upper edge sealingly connected to a top wall, said inner surface of said side wall and an inner surface of said top wall defining a second interior chamber, said side wall having a spiral shaped indentation providing a first passageway when said annular housing is positioned over said conventional cup, raised ridges of said indentation of said inner surface of said annular housing side wall fricitionally engaging said outer surface of said conventional cup;

a side wall enclosure having a third continuous smooth vertical sidewall and a bottom wall coupled to an outer surface of second sidewall forming a second passageway fluidly coupled to said first passageway;

means for sealing said passageway; whereby the beverage device is formed upon placement of a beverage in said first interior chamber of said conventional cup and positioning said annular housing means over said beverage filled cup positioning said bottom wall of said beverage filled cup within said perimeter rim of said annular housing forming a free air space between said bottom wall of said beverage filled cup and said lower perimeter rim, wherein beverage is consumed by inverting the device when placed within the annular housing allowing beverage to flow to said free air space.

12. The beverage device recited in claim 11 wherein said means for resealing said second passageway is defined as resealable tape.

13. The beverage device recited in claim 11 wherein said second passageway includes a uni-directional orifice for communicating fluid field in said second passageway to said first passageway.

14. The beverage device recited in claim 11 including a lid formed from a single piece of plastic securable to said perimeter rim of said annular housing means to cover said free air space, said lid including a resealable opening allowing beverage to consumed from said free air space.

* * * * *